United States Patent [19]

Stoner

[11] Patent Number: 4,782,767

[45] Date of Patent: Nov. 8, 1988

[54] SOLID FUEL BURNING STOVE APPARATUS

[76] Inventor: James L. Stoner, 2744 Sears Rd., Spring Valley, Ohio 45370

[21] Appl. No.: 74,630

[22] Filed: Jul. 17, 1987

[51] Int. Cl.[4] ..... F23B 7/00

[52] U.S. Cl. ..... 110/233; 110/102; 110/108; 110/234; 126/4; 126/5; 126/6

[58] Field of Search ..... 110/234, 235, 108, 102, 110/233; 126/4, 5, 6, 7

[56] References Cited

U.S. PATENT DOCUMENTS

| | | | |
|---|---|---|---|
| 1,613,265 | 1/1927 | Bryer | 110/102 X |
| 4,253,407 | 3/1981 | Larson | 110/108 X |
| 4,366,802 | 1/1983 | Goodine | 110/108 X |
| 4,543,890 | 10/1985 | Johnson | 110/102 |

*Primary Examiner*—Edward G. Favors

*Attorney, Agent, or Firm*—Richard C. Litman

[57] ABSTRACT

This apparatus relates to stoves, to devices for heating that use sawdust, ground corn cobs and other suitable materials gravity fed through a conical truncated feeder-hopper into a firebox. The heat generated raises the temperature of a tubular cylindrical structure that contains or encloses the firebox and directs gaseous by-products along its longitudinal axis to an upturned, upwardly disposed second terminal end that effects a ninety degree elbow turn, becoming a flue extension. A variety of secondary devices may be affixed to the basic heat generator or stove to provide for a variety of applications.

9 Claims, 4 Drawing Sheets

SOLID FUEL BURNING STOVE APPARATUS

BACKGROUND OF THE INVENTION

The present device relates to stoves, especially those for the purpose of generating useable heat from what is ordinarily considered waste products such as sawdust ground corn cobs, wood shavings, wood pellets and the like. More particularly this invention relates to devices for generating heat for industrial plant applications, such as small plant stream production for electrical generators or chemical processes in which steam is utilized; or, agricultural base camp operations and also for rural residential applications.

Many small industrial plants and/or agricultural processing operations, such as ranches, farms, logging sites now relay on oil based fuels for heating applications involving cooking means or providing warm water for showers and the such.

Many stoves using these and other such materials as fuel have been known for many years, however the construction of these stoves often require that many pieces be cut, formed and shaped into fashioning the stove apparatus. Furthermore, these stoves often were dedicated to one or two primary uses and would not constructed so to be flexible and adaptable to a wide variety of uses that the end-user might find convenient. This device fills a need in providing rugged and economical heating means adaptable to many different environments.

The basic heating apparatus can be embodied therefore in different housings depending on the intended end-use for the heat energy generated and on the available materials usually found in a specific environment should the device by built from a kit. As, for example, with the end-user providing the heaviest, bulkiest housing components of the device and the manufacturer providing the essential heating generating means components and technical instruction materials.

DESCRIPTION OF THE PRIOR ART

Stoves and such apparatus have been known, both patented and unpatented. The following are examplary of the U.S. prior art. They are:

| U.S. Pat. No. | Inventor |
|---|---|
| 697,444 | Canode/Wooley |
| 2,453,006 | Feight |
| 2,566,100 | Vitek |
| 4,285,328 | Fritz et al |

SUMMARY OF THE INVENTION

An object of this apparatus is to provide a device efficient in using sawdust, ground corn cobs and such materials as a source of fuel for the liberation of heat.

Another object of this device is to provide a method of generating heat from these fuels in an economical and efficiently simple apparatus such that its practical interrelation of parts can be utilized in a wide variety of remote or industrial environments.

A still further object of this invention is to provide a geometrically simple apparatus such that its very shape lends itself to the adaption of a wide variety of secondary appliances such that the use of the heat energy generated by the apparatus itself may be utilized in a variety of applications.

Another further object of this invention is to provide a safe and simple method of operation the heat generating apparatus hereinafter referred to simply as 'stove', or alternatively as heat generating apparatus.

A further object is to provide a construction such that the fire in the firebox is not smothered by an abundance of fuel being deposited on it, and further, that the stove will operate unattached for extended periods of time.

A further object is to provide a construction such that ash may be cleaned out while the stove is in operation and that neither burning ash nor fuel in the firebox will ignite fuel in the hopper of the apparatus.

A still further object is to provide a construction permitting the temperature in the heating apparatus to be largely controlled by the amount of influx of air through the firegrate of the device.

A still further object to provide a construction such that sawdust or other suitable fuels may be fed into the stove at a rate largely independent of the amount of fuel in the fuel hopper, and in conjunction with the amount of fuel, that fuels may, in fact, be deposited in the hopper in layers such that the different fuels will burn for varying periods of time, at varying temperatures, based on the rate and caloric output of the fuel.

DESCRIPTION OF THE DRAWINGS

FIG. 4 (*a*) is a sectional view along axis A—A of FIG. 4 illustrating a hotplate unit mounted over a tubular cylindrical structure and further illustrating a means of mounting the hotplate to the tubular cylindrical structure.

FIG. 4(*b*) is a section view along axis B—B of FIG. 4 which illustrates a structural detail of the mounting means for an oven unit to be positioned over the tubular cylindrical structure.

DESCRIPTION OF THE PREFERRED EMBODIMENT

Figure 1:
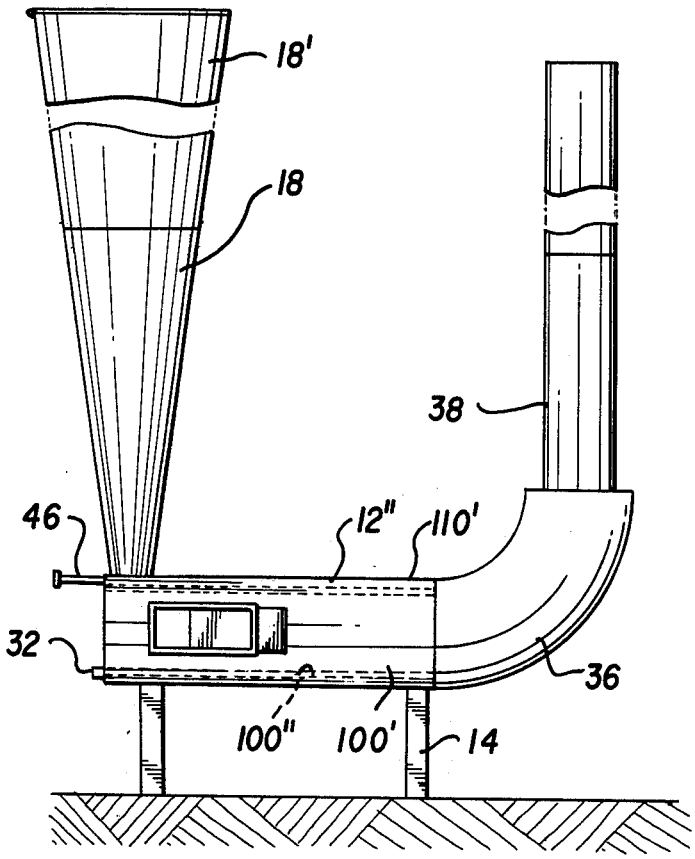
FIG. 1 is a front elevation showing a longitudinally disposed housing structure supported on vertical legs or supports.
Figure 2:
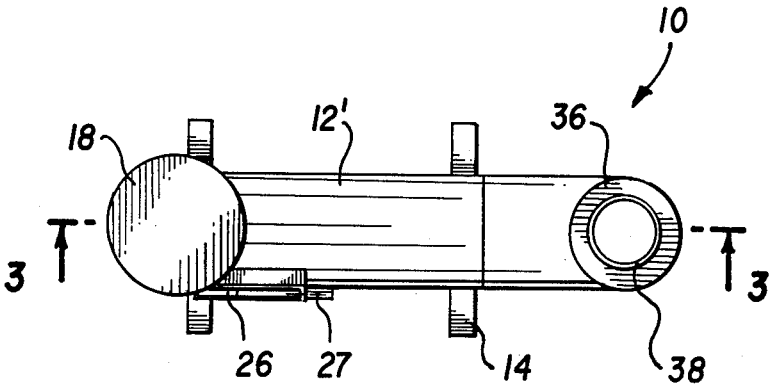
FIG. 2 is a top or plan view of the apparatus.
Figure 3:
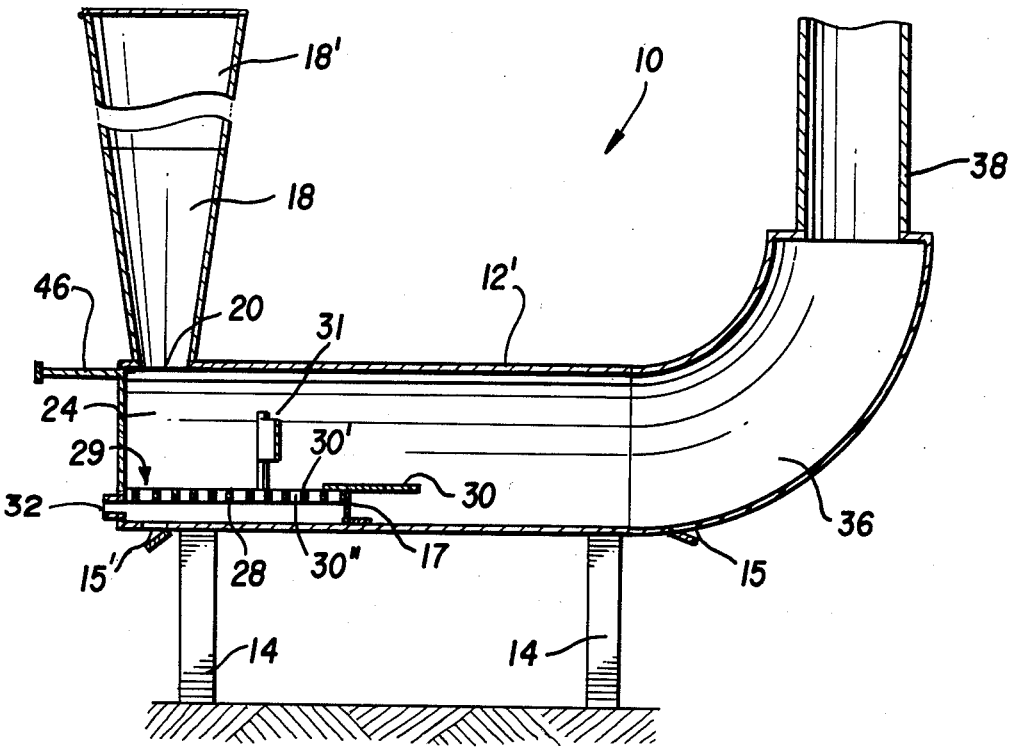
FIG. 3 is a sectional view along cutting plane 3—3 in FIG. 2, illustrating the firebox and firegrate within the longitudinally disposed housing structure.

Referring now to FIGS. 1 through 3, apparatus 10 consists of a housing structure 12 substantially disposed horizontally over a plurality of support members 14.

Tubular elbow conduit 36 bends, substantively at right angles to the housing structure 12, and is upwardly disposed to accept flue conduit 38 for the elimination of by-products of gaseous combustion within the apparatus. Conically truncated feeder-hopper 18 extends upwardly from the upper surface of housing structure 12, the conically truncated feeder-hopper 18 being disposed proximate to the first terminal end of housing structure 12. The fuel in feeder-hopper 18 is protected from the elements by hopper lid 19, which pivots on hinging means 19' to allow an operator to swing back the lid to replenish the supply of fuel.

Hopper extension 18' may, optionally, be mounted on hopper 18 such that a large amount of grandular fuel may be deposited therein. Further, a variety of fuels may be placed in the feeder-hopper extension in layered deposits such that, as the fuels burn the various deposits are drawn downward into the apparatus; each layer of fuel burning with a characteristic heat or caloric output, which in turn allows the apparatus to burn within a given temperature range.

Feeder-hopper orifice 20 is restricted in diameter to a few inches such that fuels will continue to flow downward through said orifice and will not, conversely, clot to form an obstruction to the flow of fuel downward into the stove. A further advantage to restricting the size of hopper orifice 20 is that such a restriction prevents a 'slow-burn' or a combustion of fuels up in the hopper itself.

Fuel control handle 46 is slidably disposed to feeder-hopper orifice 20 such that fuel may be shut down, prevented from being gravity fed through orifice 20, or conversely opened to admit grandular fuel from feeder-hopper 18, with the result that combustion activity may continue or be shutdown completely. Fuel control handle, slider 46, is a open or closed. two-position control as intermediate positions cause the fuel to obstruct orifice 20.

Housing structure 12 encloses firebox 24, a firegrate 28, both firegrate 28 and firebox 24 being disposed under feeder-hopper orifice 20 such that as fuel is gravity fed down through feeder-hopper orifice 20, the fuel is deposited down onto upper surface of firegrate 28. The conically truncated feeder-hopper 18 providing 'lift' to the fuel disposed therein such that feeder-hopper 18 provides a steady flow of materials downwardly through orifice 20 to firegrate 28.

Firegrate 28 having a plurality of orifices or openings 29 disposed thereon, in a matrix or grate interspaces that are approximately ½ inch in diameter, such that granular fuel filters down to the firegrate.

Granular fuel accumulates on firegrate 28 such that it may extend upward heaped on the firegrate up to feeder-hopper orifice 20. As it spills along firegrate 28 it encounters restrictor band 31, which is vertically disposed to both firegrate 28 and firegrate extension 30.

Restrictor band 31 is, in essence, a port under which a portion of the acculumated fuel may pass. As a small portion of fuel flows, under gravity, under restrictor band 31, it falls to a small area 30' existing between firegrate 28 and solid firegrate extension 30.

A small plurality of orifices are disposed in area 30', the combustion area, such that as air flows in through inlet 32, it is drawn up through orifices 30" and thereby mixing with the small amount of granular fuel on combustion surface 30'.

Heated air, rising through flue conduits 38 causes a negative pressure to envelope firebox 24 on the upper surfaces of combustion grate 30' and within the a surrounding air chamber such that air is drawn upward through interspaces 30" to support and continue the combustion of fuel.

Air does not, typically, enter upward through firegrate orifices 29, because of the accumulations of granular fuel above the firegrate 28. As air is directed, horizontally along, and under the firegrate 28, it encounters extension barrier 17 such that it is further directed up through combustion orifices 30". and at point combustion takes place.

Firegrate 28, firegrate extension 30 and restrictor band 31, function in cooperative arrangement to force incoming air from air inlet port 32 under the firegrate 28 and up through combustion orifices 30".

Due to the flow of air through the apparatus, some burning may also continue over onto the firegrate extension surface 30. Ash from the combustion is taken by the direction of air through the apparatus toward elbow 36.

Proximate to the upturn at elbow 36, a primary ash cleanout door 15 is provided. Ash, as carried by air currents moving through the apparatus accumulates near the bottom of the flue as air exists upward.

A secondary ash cleanout 15' is located under the firebox 24 such that ash that does accumulate by falling through combustion orifices 30", or firegrate 28, can be cleaned out.

The longitudinal airflow channel thus provided by flue conduit 38 being opposite to air inlet 32, the firebox and firegrate 28 being disposed intermediately to them, the truncated conical feeder-hopper 18 being vertically disposed, proximate to firegrate 28, all combine in operation to draw and channel incoming air upward through combustion grate 30' and thence outward along the longitudinal axis of housing structure 12 to flue conduit 38.

The operation of the heating apparatus being largely controllable by the amount of air allowed to pass inlet port 32, having means for controlling air therethrough such as a butterfly valve. Flue conduit 38 contains dampening means 39 such that the draft of air through the tubular heat generating unit or device may likewise be controlled.

Ignition box 26 is mounted on housing structure 12. Ignition box door 27 being slidably disposed within ignition box 26.

Barrier 17 prevents air from passing straight under firegrate 28, forcing air up through combustion grates 30". Ash cleanouts 15, 15' are provided, although barrier 17 may, alternatively, be hinged substantially as shown in FIG. 3 to fold down such that a single cleanout can be used.

Figure 4:
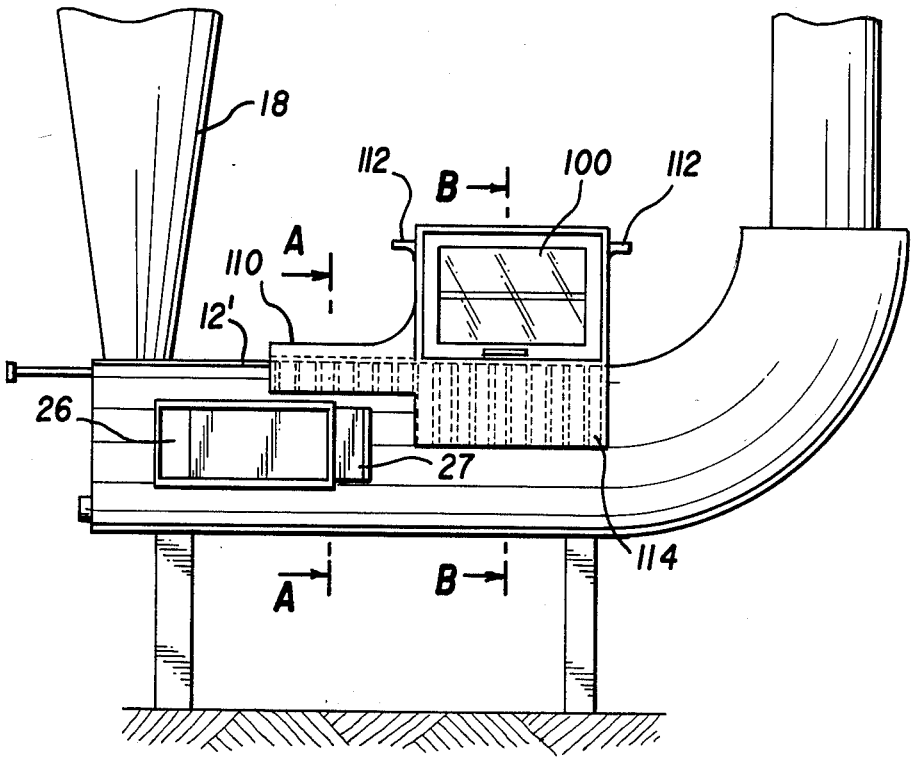
FIG. 4 is an elevation view showing a oven and hotplate unit as adapted for use with an oven and hotplate.
Figure 4A:
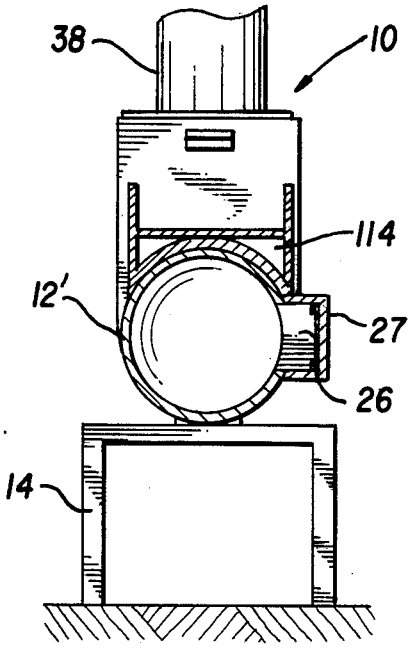
Figure 4B:
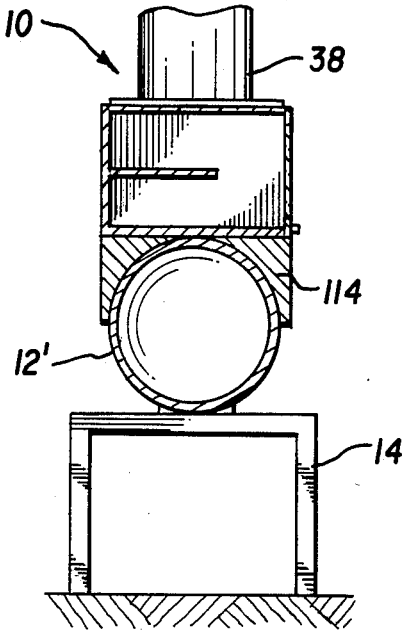

FIG. 4 illustrates a first embodiment of the basic heat generating apparatus with a oven module 100 attached thereto such that the length of the housing structure 12 is utilized effectively to capture heat as generated by the unit. Oven and hotplate unit 100 is mounted onto a tubular cylindrical structure 12'.

FIG. 4 (*a*) and (*b*) are sectional views through A—A and B—B of FIG. 4 in which curvilinear fins 114 interface to tubular cylindrical structure 12'. Support curvilinear fins 114 being spaced along the length of oven and hotplate unit 100 such that radiant heat from firebox 24 is radiated by convexion through curvilinear fins 114 and thence to the interior of the oven and to the planar cooking surface 110. Handles 112 are used to lift or fit unit oven and hotplate onto the basic apparatus.

Figure 5:
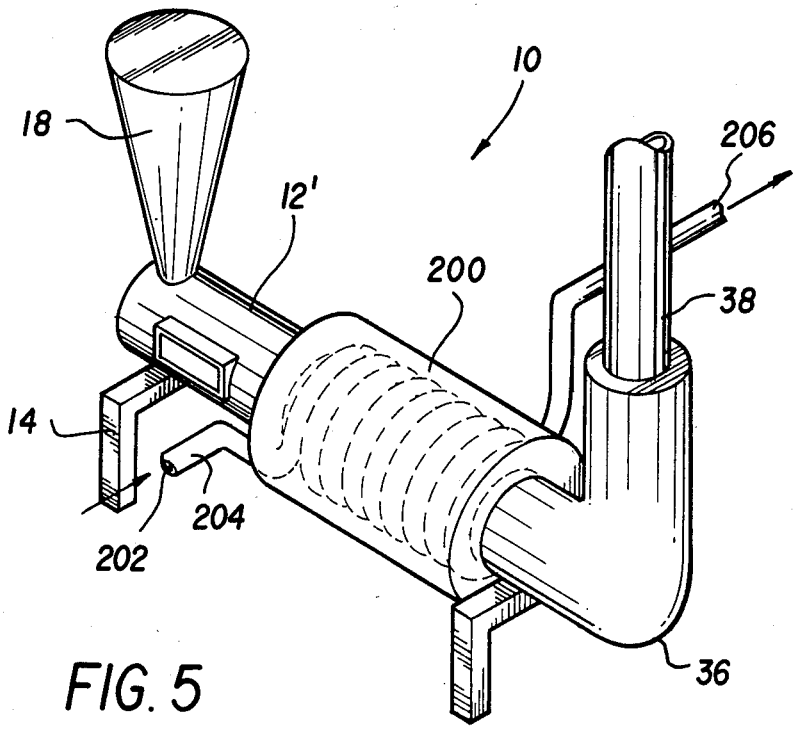
FIG. 5 is a perspective view showing a water jacket module substantively encompassing the tubular cylindrical structure.

FIG. 5 is an illustration of the basic heat generating apparatus with a hot water heater, again showing the benefits of a curvilinear, tubular structure 12' in both mounting auxiliary equipment and in capture of radiant heat from the unit. Segmented water heating jacket 200 is disposed over tubular cylindrical structure 12'.

Tubular water coils 204 are deployed inside segmented water heating jacket 200 such that as water is pumped through inlet 202 and thence through tubular water coils 204, heat by convexion is absorbed from the apparatus and thence to outlet 206.

Figure 6:
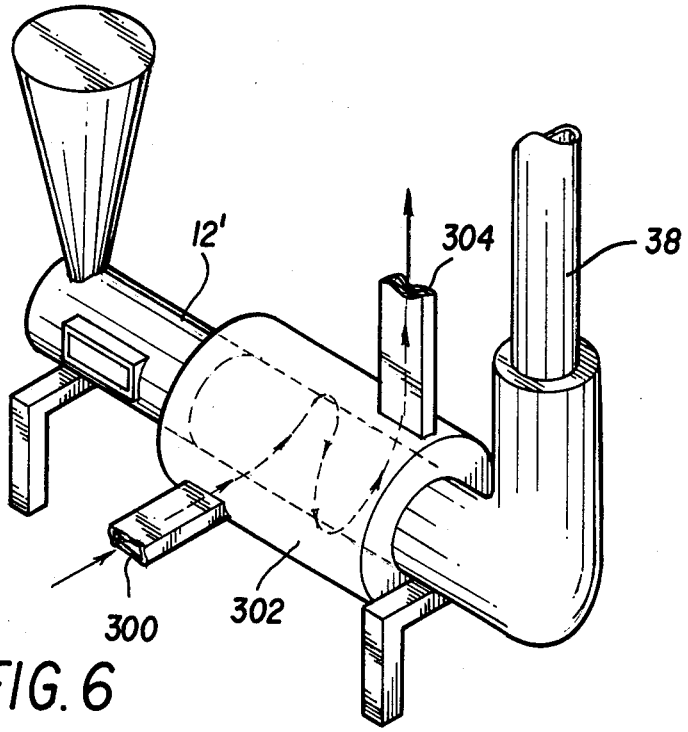
FIG. 6 is a perspective view indicating the construction of a warm air heating module substantively encompassing the tubular cylindrical structure.

FIG. 6 is an illustration of the basic heat generating apparatus with a hot air heating module 302 attached thereto, again showing, by example, the relative advantage of the simplicity of the structure, the inherent advantage of and utility of the basic heat generating apparatus.

Figure 7:
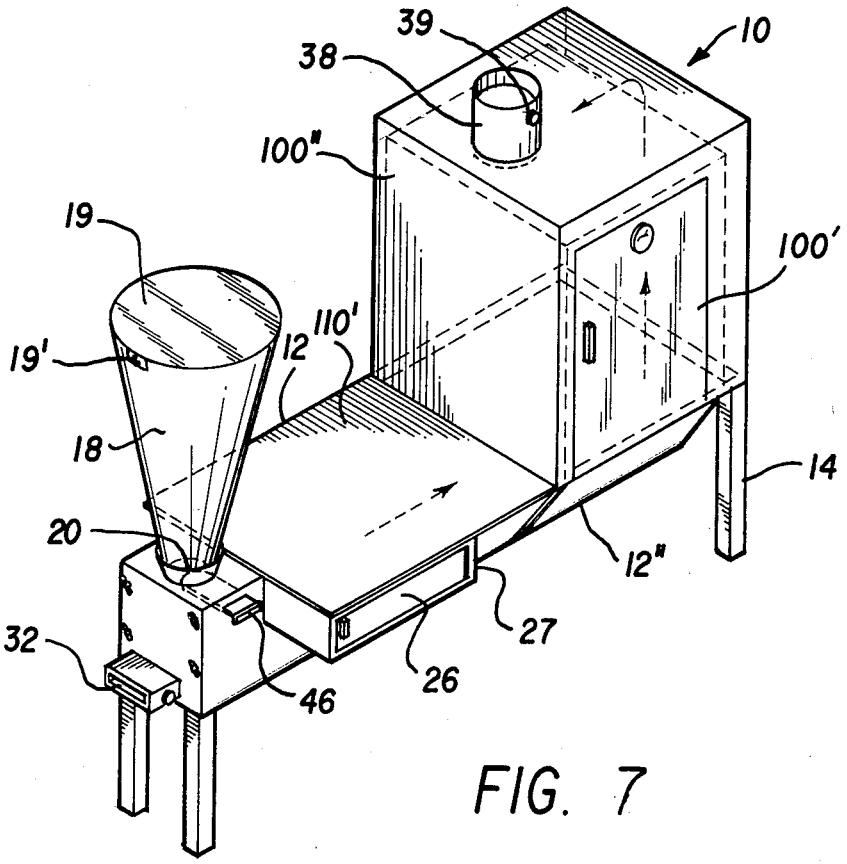
FIG. 7 is a perspective view of an alternative embodiment.

A second or alternative embodiment is illustrated in FIG. 7 in which housing structure 12'' has a cross section substantively rectangular. Upper planar surface 110' thereby forming a built-in hotplate.

Oven unit 100' being integral to housing structure 12'' flue conduit 38 being vertically disposed within oven 100' such that heat energy is utilized as heated gases move up the flue conduit.

Combustion gases being routed through double-sided walls 100'', the gases circulating under the oven, between the interior and exterior wall, across the top and exiting at flue 38.

It is understood that many modifications and changes will readily occur to those skilled in the art of manufacturing and design of wood/sawdust or other fueled stoves and such appliances and therefore the disclosure herein should be viewed as indicating the invention only be way of example. The invention being limited only by the claims.

What is claimed is:

1. A stove or heat generating apparatus for burning sawdust, ground corn cobs, wood pellets, and other materials comprising:

a plurality of vertical structural supports;

a housing structure disposed substantially horizontally over said vertical structural supports;

said housing structure having two terminal ends; a first terminal end and a second terminal end;

said second terminal end being disposed at a proximate right angle, upwardly, from a longitudinal axis of said housing structure;

a firebox;

said firebox being substantively horizontally disposed within said housing structure;

a truncated conical tubular feeder-hopper; said truncated conical tubular feeder-hopper being upwardly or vertically disposed on said housing structure;

said truncated conical tubular feeder-hopper having a hinged lid disposed on the top thereof;

said truncated conical tubular feeder-hopper being disposed proximate to said first terminal end of said housing structure;

said housing structure and said truncated conical tubular feeder-hopper having a two-position slidably disposed fuel control handle means for controlling the gravity fed passage of fuel from said feeder-hopper into said firebox for the cooperative regulation of fuel into said firebox;

a firegrate having a plurality of combustion orifices;

said firegate being substantially horizontally disposed within said firebox; said firegrate being disposed proximate to said first terminal end of said housing structure and said firegate being disposed proximate to said truncated conical feeder-hopper such that solid fuel flows downward from said truncated conical feeder-hopper onto said firegrate and accumulates thereon;

a solid firegrate extension and a restrictor band which function in cooperative arrangement with said firegrate to force air for combustion through said combustion orifices in said firegrate;

a flue conduit;

said flue conduit substantively vertically disposed over second terminal end of said housing structure;

said housing structure and said firebox having means for the cooperative inflow of air thereto and the regulation thereof in said firebox;

said housing structure, truncated conical tubular feeder-hopper, said flue conduit, said firebox constructing thereby an apparatus for the burning of ground corn cobs, sawdust and other combustible grandular fuels therethrough.

2. A stove or heat generating apparatus as recited in claim 1 wherein said housing structure is a tubular cylindrical structure.

3. A stove or heat generating apparatus as recited in claim 1 wherein said housing structure comprises substantially planar surfaces such that, in cross section, said housing structure is substantively rectangular.

4. A stove or apparatus as recited in claim 1 wherein: said feeder-hopper has and extension thereon, whereby said apparatus may be operated unattended for long periods of time.

5. A stove or apparatus as recited in claim 1 wherein: said stove or apparatus contains means for ash removal while apparatus is in operation.

6. A stove or heat generating as recited in claim 1 wherein:

said stove has means for mounting an oven module thereon.

7. A stove or heat generating apparatus as recited in claim 1 wherein:

said stove means for mounting a hot water module thereon.

8. A stove or heat generating apparatus as recited in claim 1 wherein:

said stove has means for mounting a hot plate module thereon.

9. A stove or apparatus as recited in claim 1 wherein: said stove or apparatus has means for heating air;

said means consisting of a jacket module disposed over said stove; said jacket having means for a circulation of air therethrough, whereby said air is warmed by convexion by said stove or heating apparatus.

* * * * *